US007097048B2

(12) United States Patent
Rimback et al.

(10) Patent No.: US 7,097,048 B2
(45) Date of Patent: Aug. 29, 2006

(54) SHOE RACK

(75) Inventors: Peter D. Rimback, South Euclid, OH (US); James F. Vidmar, Willoughby, OH (US)

(73) Assignee: HSN Improvements, LLC, St. Petersburg, FL (US)

( * ) Notice: Subject to any disclaimer, the term of this patent is extended or adjusted under 35 U.S.C. 154(b) by 163 days.

(21) Appl. No.: 10/613,662

(22) Filed: Jul. 2, 2003

(65) Prior Publication Data

US 2004/0118791 A1 Jun. 24, 2004

Related U.S. Application Data

(60) Provisional application No. 60/393,461, filed on Jul. 2, 2002.

(51) Int. Cl.
*A47F 7/08* (2006.01)

(52) U.S. Cl. ..... 211/34

(58) Field of Classification Search ..... 211/34, 211/35, 113, 118, 119.004, 36, 119.003
See application file for complete search history.

(56) References Cited

U.S. PATENT DOCUMENTS

| | | | | | |
|---|---|---|---|---|---|
| 1,769,344 | A | * | 7/1930 | Hoffmire | 211/34 |
| D121,112 | S | * | 6/1940 | Deja | D6/317 |
| 2,299,021 | A | * | 10/1942 | Hoffman | 211/34 |
| 2,620,929 | A | | 12/1952 | Sportsman | 211/42 |
| 3,792,804 | A | | 2/1974 | Ponzo | 223/85 |
| D287,550 | S | * | 1/1987 | Tocci | D6/320 |
| D377,728 | S | * | 2/1997 | Klein et al. | D6/570 |
| 5,617,959 | A | * | 4/1997 | Klein et al. | 211/37 |
| D381,225 | S | * | 7/1997 | Malik | D6/513 |
| D382,434 | S | | 8/1997 | Klein et al. | D6/570 |
| D385,481 | S | | 10/1997 | Klein et al. | D8/373 |
| 5,690,239 | A | * | 11/1997 | Ballard | 211/189 |
| 5,695,073 | A | | 12/1997 | Klein et al. | 211/35 |
| 5,855,279 | A | | 1/1999 | Klein et al. | 211/35 |
| 6,464,086 | B1 | * | 10/2002 | Klein et al. | 211/35 |
| D481,560 | S | * | 11/2003 | Vidmar et al. | D6/491 |
| 6,786,337 | B1 | * | 9/2004 | Klein et al. | 211/34 |
| 2003/0085188 | A1 | * | 5/2003 | Klein et al. | 211/118 |
| 2004/0245192 | A1 | * | 12/2004 | Hu | 211/34 |

* cited by examiner

*Primary Examiner*—Sarah Purol
(74) *Attorney, Agent, or Firm*—Kenyon & Kenyon LLP

(57) ABSTRACT

A shoe rack including at least one frame structure and a hanger coupled to the frame structure, the hanger being shaped to couple the shoe rack to a generally vertically-oriented support surface such that the frame structure is located generally adjacent to the support surface. The frame structure includes a plurality of support arms shaped to extend generally away from the support surface when the frame structure is located generally adjacent to the support surface. The rack includes a plurality of generally horizontally-oriented, vertically spaced inner rungs coupled to the frame structure and a plurality of generally horizontally-oriented, vertically spaced outer rungs coupled to the frame structure. The rack further includes a plurality of generally vertically-oriented struts, each strut extending between adjacent ones of the outer rungs or adjacent ones of the support arms to provide vertical support to the outer rungs and the support arms.

59 Claims, 5 Drawing Sheets

SHOE RACK

This application claims priority to U.S. provisional application Ser. No. 60/393,461, filed Jul. 2, 2002, the contents of which are hereby incorporated by reference.

FIELD

The present invention relates generally to shoe racks and, more particularly, to hanging-type shoe racks which can be installed onto a door, wall or other generally vertically-extending surface.

BACKGROUND

Many types of shoe racks have been developed for storing shoes, including racks designed to be suspended from a hinged door. Such shoe racks typically utilize one or more generally inverted U-shaped hooks to fit over the top edge of the door, with a rack assembly being suspended vertically from the hooks along the length of the door. A problem frequently encountered with such racks is a lack of structural rigidity. Prior shoe racks tend to deflect under the weight of the shoes, causing vertical support members to curve away from the door. Shoe racks in this condition have an undesirable appearance, weakened vertical supports, and an unstable structure that is prone to failure.

Some shoe racks retain the shoes stored thereon in an inclined position such that the heel or toe of the shoe rests against the door or wall supporting the rack to prevent the shoes from falling off the rack. An example of this approach can be seen in U.S. Pat. No. 5,855,279, issued to Klein et al., which discloses a shoe rack having a plurality of support arms projecting outwardly and downwardly from a vertical frame. The rack includes sets of generally horizontally-extending retaining bars positioned between frame members and aligned in a plane forming an acute angle with respect to vertical to support the shoes in a downward-angled manner A problem with prior shoe racks is that they are generally suspended such that the rack engages the door at only a few points, such as at the top and bottom of the rack, and/or at points about one-third and two-thirds the length of the rack as measured from the top of the rack. This can result in an unstable structure that is prone to a rocking motion. Excessive rocking can cause the hangers or hooks to eventually work free from the door, causing the rack to fall. In addition, repetitive rocking motion can also cause structural fatigue in the rack components and thereby reduce the life of the rack.

Still another shortcoming of prior shoe racks is their lack of expandability. Most shoe racks have a fixed capacity, which may be either excessive or inadequate for particular users. Users needing more capacity will often simply stack as many shoes as possible into the volume available on the rack, potentially exceeding the safe holding capacity of the rack and causing it to fail.

Accordingly, there is a need for a shoe rack having sufficient structural strength to withstand the loads imposed by the shoes without deformation. There is also a need for a shoe rack sufficiently stable to withstand the acceleration and deceleration forces encountered by the opening and closing of a door from which the rack is suspended. There is also a need for a modular shoe rack to allow multiple racks to be suspended together without an appreciable reduction in structural integrity.

SUMMARY

The present invention overcomes the aforementioned limitations of prior shoe racks by providing a rack that is structurally sound, stable and expandable. In one embodiment, the rack includes a hanger that is shaped to fits over the top of the door to support the rack, and a frame structure coupled to the hanger. The frame structure may include a plurality of support arms extending generally away from the support surface. The rack may include a plurality of generally horizontally-oriented, vertically spaced inner rungs extending between adjacent support arms, and a plurality of generally horizontally-oriented, vertically spaced outer rungs extend between adjacent support arms. The rack may include a plurality of generally vertically-oriented braces extending between adjacent outer rungs, and/or inner rungs, and/or support arms to provide vertical support to the outer rungs and the support arms.

In one embodiment, the invention is a shoe rack including at least one frame structure and a hanger coupled to the frame structure, the hanger being shaped to couple the shoe rack to a generally vertically-oriented support surface such that the frame structure is located generally adjacent to the support surface. The frame structure includes a plurality of support arms shaped to extend generally away from the support surface when the frame structure is located generally adjacent to the support surface. The rack includes a plurality of generally horizontally-oriented, vertically spaced inner rungs coupled to the frame structure and a plurality of generally horizontally-oriented, vertically spaced outer rungs coupled to the frame structure. The rack further includes a plurality of generally vertically-oriented struts, each strut extending between adjacent ones of the outer rungs or adjacent ones of the support arms to provide vertical support to the outer rungs and the support arms.

Other objects and advantages of the present invention will be apparent from the following description and the accompanying drawings.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
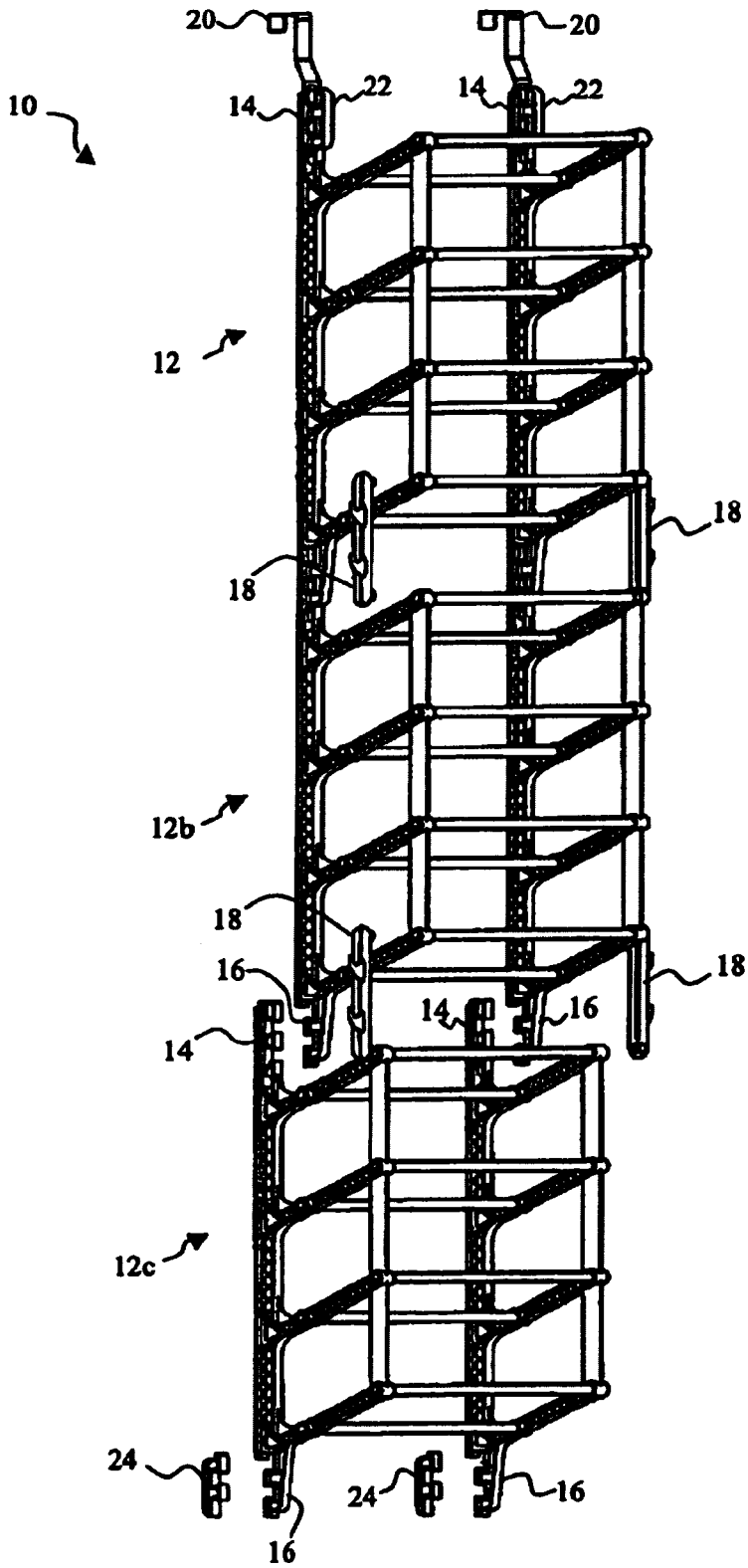
FIG. 1 is a perspective view of the general arrangement of a shoe rack assembly according to an embodiment of the present invention.

A perspective view of the general arrangement of a shoe rack 10 according to an embodiment of the present invention designed is shown in FIG. 1. The shoe rack 10 may include a plurality of modules 12*a*, 12*b* and 12*c* (also enumerated herein as 12*a–c*). Each module 12*a*, 12*b*, 12*c* may include a set of upper connector portions 14, lower connector portions 16 and braces 18 which can coupled the modules 12*a*, 12*b*, 12*c* together. The shoe rack 10 may include a pair of hangers 20 that are shaped or adapted to fit over a top surface of a door (not shown), and each hanger 20 may be coupled to the upper connector portions 14 of the uppermost module 12*a* by a pair of hanger retainers 22. The shoe rack 10 may include a pair of covers 24 coupled to the lower connector portions 16 of the bottom-most module 12*c*.

Figure 2:
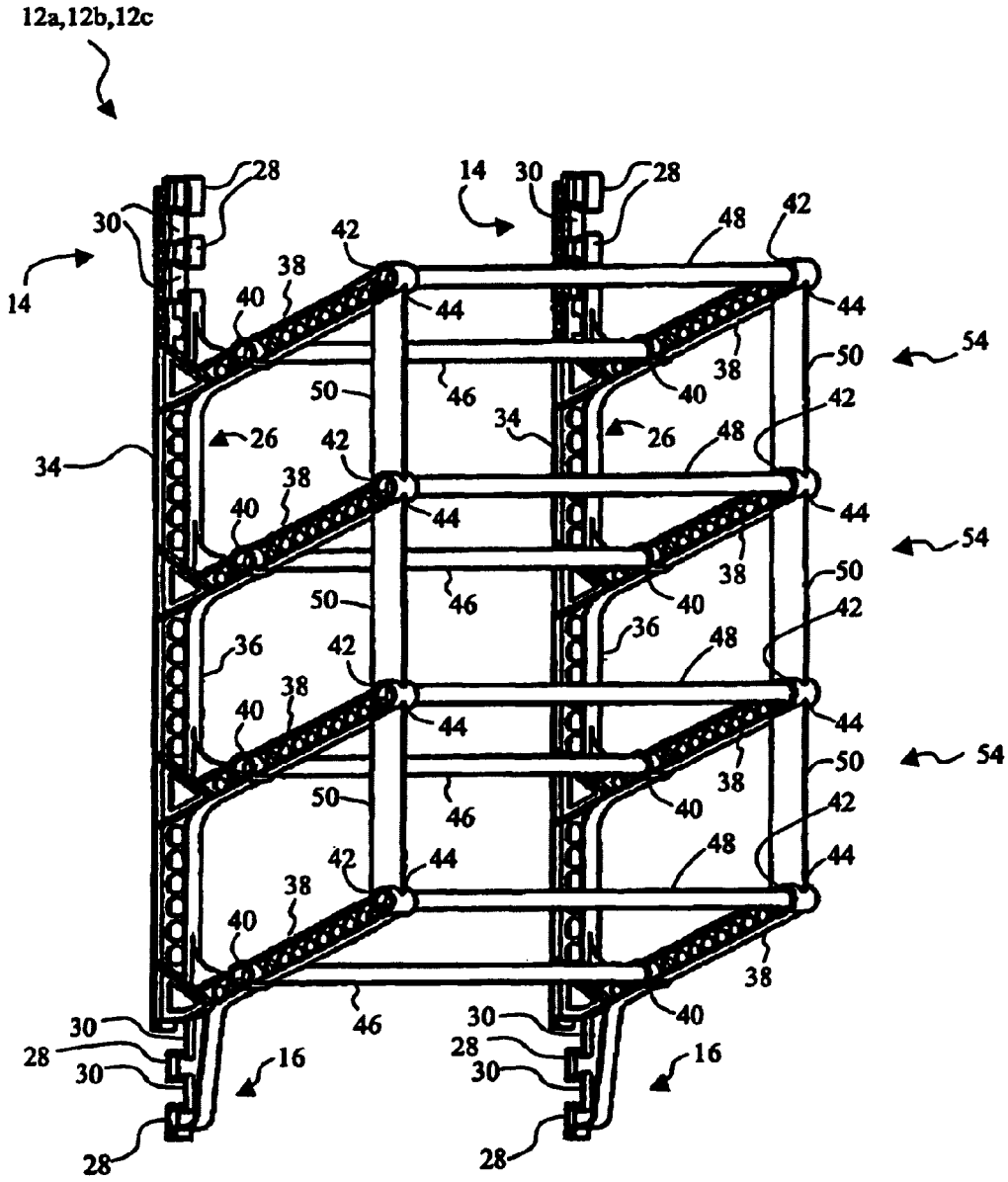
FIG. 2 is a detailed perspective view of a module of the shoe rack assembly of FIG. 1.

Details of one of the modules 12*a–c* are shown in greater detail in FIG. 2. Each of the modules 12*a–c* may include a pair of elongate, generally vertically-oriented frames or frame structures 26. The frames 26 may be arranged such that they are generally parallel and spaced apart in a lateral direction (i.e. across the width of a vertical support surface, such as a door, not shown). Each frame 26 may have an upper connector or upper connector portion 14 and a lower connector or a lower connector portion 16 located at opposite distal ends thereof. As is best seen with additional reference to FIG. 3, each upper and lower connector portion 14, 16 may include protruding, generally rectangular or trapezoidal teeth 28 defining generally rectangular or trapezoidal recesses 30 therebetween.

Each of the teeth 28 may have a pair of opposed edges 32 that are shaped to couple with like-shaped teeth of mating connector portions. The edges 32 may be angled or irregularly shaped to provide structural stability when mated. For example, in the illustrated embodiment the edges 32 may be angled to provide the generally trapezoidal shape to the teeth 28 and recesses 30. In this configuration, the connector portions can only be coupled together by laterally sliding the corresponding teeth 28 into the recesses 30, and the teeth 28 cannot be pulled out of a corresponding recesses by forces extending generally perpendicular to the door.

Each frame 26 may also have a generally flat rear surface 34 which can be aligned (i.e., lie in a common plane) with the rear surface of the frames 26 of adjoining modules so that the rack 10 may rest generally against a door or other similar vertical support surface. Each frame 26 may further include a base portion 36 and a plurality of support arms 38 extending generally perpendicular to the base portion 36.

In the embodiment illustrated in FIG. 2, each frame 26 includes four support arms 38, although of course the number of support arms 38 may be varied as desired. Although not shown, each support arm 38 may be removably attachable to the associated base portion 36 by, for example, an interference fit. Each support arm 38 may further include a generally horizontally-oriented inner rung receptacle 40 located at or adjacent to the base portion 36 of the associated support arm 38. Each support arm 38 may also include a generally horizontally-oriented outer receptacle 42 located at or adjacent to the distal end of the associated support arm 38. Each receptacle 40, 42 may include a generally cylindrically-shaped opening having a generally horizontally extending axis.

Each support arm 38 may optionally have a generally vertically-oriented strut receptacle 44 located at or adjacent to the distal end of the support arms 38. Each strut receptacle 44 may include a generally cylindrically-shaped opening having a generally vertically extending axis. However, the inner and outer rung receptacles 40, 42 and strut receptacles 44 need not be generally cylindrical, so long as they are appropriately shaped to receive the associated components therein. When the receptacles 40, 42, 44 are cylindrical, the receptacles have a constant uniform inner diameter and may include an internal partition (not shown) located midway (or at some other depth) through the bore of the receptacles 40, 42, 44. Of course, the orientations of the receptacles may be reversed such that the frames 12 includes male portions received in receptacles of the rungs 46, 48 and/or struts 50. It is noted that each of the frames 26 forming any module 12*a–c* may be identical, thereby eliminating the need for separate "left" and "right" frames.

Each module 12*a–c* may include a plurality of generally horizontally-extending inner rungs 46 and a plurality of generally horizontally-extending outer rungs 48. The distal end of each inner rung 46 may be received in horizontally aligned inner rung receptacles 40 of the support arms 38. Similarly, the distal end of each outer rung 48 may be received in horizontally aligned outer rung receptacles 42 of the support arms 38. Each rung 46, 48 may be generally cylindrical and shaped to be closely received in the corresponding rung receptacles 40, 42 respectively, by an interference fit, and a rung 24, 26 may be located in each of the inner and outer rung receptacles 40, 42. Each outer rung 48 may be generally horizontally aligned with an associated inner rung 46. However, various other configurations may be used, including in one embodiment outer rungs 48 which are located vertically above an associated inner rung 46, in which case each support arm 38 may be angled slightly upwardly as the support arm 38 extends away from the associated base portion 36.

Each module 12*a–c* may further include a plurality of generally vertically-oriented struts 50. The struts 50 are preferably made integral to the support arms 38, in which case the frame 12 and/or support arms 38 may not include any strut receptacles 40. In an alternate embodiment, the struts 50 may be separable from the support arms 38, in which case the struts may have a plurality of strut receptacles 44 located therein to receive the struts 50. However, if the struts 50 are removably coupled to the arms 38/frame 12, the struts should be coupled so that the resulting interface between the struts 50 and the arms 38/frame 12 is sufficiently rigid and robust. Each strut 50 may be generally cylindrical or square in cross section. If the struts 50 are removably coupled to the support arms 38, each strut may be adapted to be closely received in the corresponding strut receptacles 44 by an interference fit and/or secured with an adhesive or by other means. The distal end of each strut 50 may couple to a pair of opposed support arms 38.

Each module 12*a–c* may be assembled by placing a pair of vertical frames 26 adjacent to each other in a parallel and spaced-apart configuration. The inner rungs 46 may be installed by placing the inner rungs 46 between the frames 26, and orienting the inner rungs 46 generally perpendicular to the frames 26 (i.e. generally perpendicular to a plane defined by the frames 26). The inner rungs 46 may then be secured by pressing the ends of the inner rungs 46 into inner rung receptacles 40 of the support arms 38 until the inner rungs 46 are fully seated or are pressed against partitions (not shown) located in the receptacles 40.

The outer rungs 48 may likewise be located between the frames 26 and oriented generally perpendicular to the frames 26. The outer rungs 48 may be secured by pressing the ends of the outer rungs 48 into the outer rung receptacles 42 located at the distal ends of the support arms 38 until the outer rungs 48 are fully seated therein or are pressed against partitions (not shown) located in the receptacles 42. The outer rungs 48 may be spaced apart from the inner rungs 46 by a distance sufficient to support a pair of shoes thereon, such as, in one embodiment, between about 5 inches and about 15 inches, and in one embodiment about 7 inches.

As previously noted, the struts 50 are preferably made integral to the support arms 38. For embodiments wherein the struts 50 are separate or separable components, a plurality of struts 50 having ends adapted to couple to the strut receptacles 44 are then provided. The struts 50 are oriented parallel to the frames 26, then pressed into the connector receptacles 44 of adjacent support arms 38 until fully seated therein or are pressed against partitions (not shown) located in the receptacles 44 to link the support arms 38 vertically.

Once assembled, the modules 12*a–c* may form or include a series of generally rigid, vertically stacked box-like structures 54 (i.e., in the embodiment illustrated in FIGS. 1 and 2, three boxes 54 to a module 12*a–c*) wherein the sides of each box 54 are formed by the support arms 38, the base portion 36 of the frames 26, the struts 50, the inner rungs 46, and the outer rungs 48. The box-like structures 54 may be generally closed and have front, rear, left, right, top and bottom sides, with all sides being generally planar, generally rectangular and generally perpendicular to each other. The struts 50 may provide vertical support for the boxes 54 to add rigidity and to help support the weight of shoes located on the rungs 46, 48, particularly the rungs 48.

Figure 3:
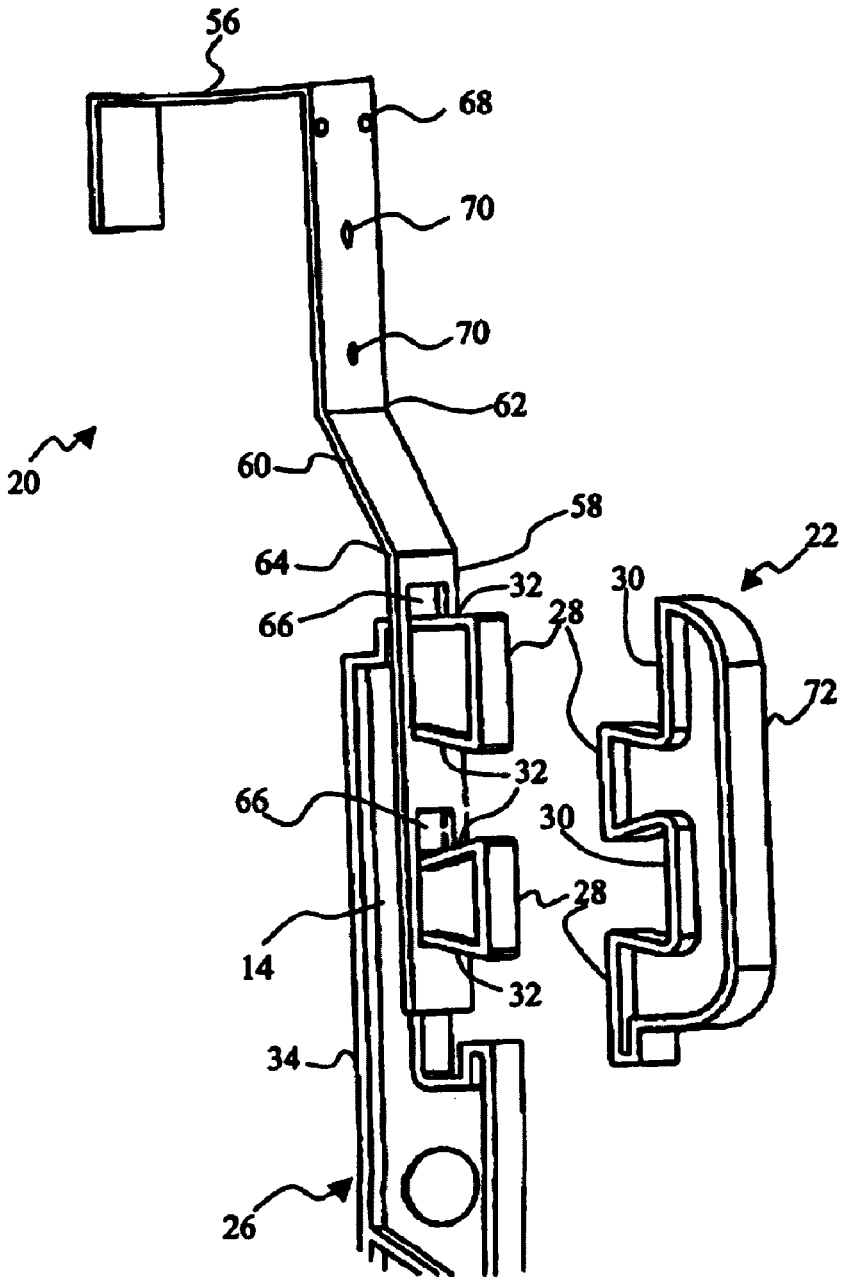
FIG. 3 is a detailed perspective view of a hanger and a hanger retainer for the shoe rack of FIG. 1.

The rack 10 may include a hanger 20 at or adjacent to its upper end for coupling the rack 10 to a door or other generally vertically-extending support surface. The general arrangement of the hanger 20 is illustrated in FIG. 1, while details of the hanger are shown in FIG. 3. The hanger 32 may include an upper, generally inverted "U" shaped receiving portion 56 which is shaped to be hooked over the upper horizontal edge of a door. The hanger 20 may also include a lower portion 58 coupled to the receiving portion 56 by a generally outwardly-directed spacer portion 60 defined by an upper bend angle 62 and a lower bend angle 64. The spacer portion 60 may be configured such that the lower portion 58 of the hanger 20 may be generally parallel to the supporting door but sufficiently laterally spaced apart from the door to allow the frames 26 to fit between the lower portion 58 and the door and such that the rear surfaces 34 of the frames 26 rest against the door.

The lower portion 58 of the hanger 20 may include a set of apertures 66 which are shaped and located to receive the teeth 28 of the upper connector portion 14 of a frame 26 therethrough to thereby suspend a frame 26 from the hanger 20. If desired, the receiving portion 56 may be broken off at a set of perforations 68 formed therethrough by, for example, repeatedly bending the hanger 20 at the perforations 68 until the hanger 20 separates along the set of perforations 68. The receiving portion 56 may then be discarded, and a set of mounting holes 70 formed through the hanger 20 may be used to mount the shoe rack 10 directly to a door or other vertical structure, such as by passing fasteners through the holes 70 and into the door.

Details of a hanger retainer 22 are illustrated in FIG. 3. The hanger retainer 22 may have a plurality of teeth 28 and recesses 30 adapted to mate with corresponding recesses 30 and teeth 28 respectively of the upper connector portion 14 of frame 26. The hanger retainer 22 may be adapted to couple to the upper connector portion 14 such that the hanger 20 is captively retained between the upper connector portion 14 and the hanger retainer 22. An outer surface 72 of the hanger retainer 22 may be generally smooth and curved to provide a smooth, finished appearance to the hanger retainer 22 when the rack 10 is assembled.

Figure 4:
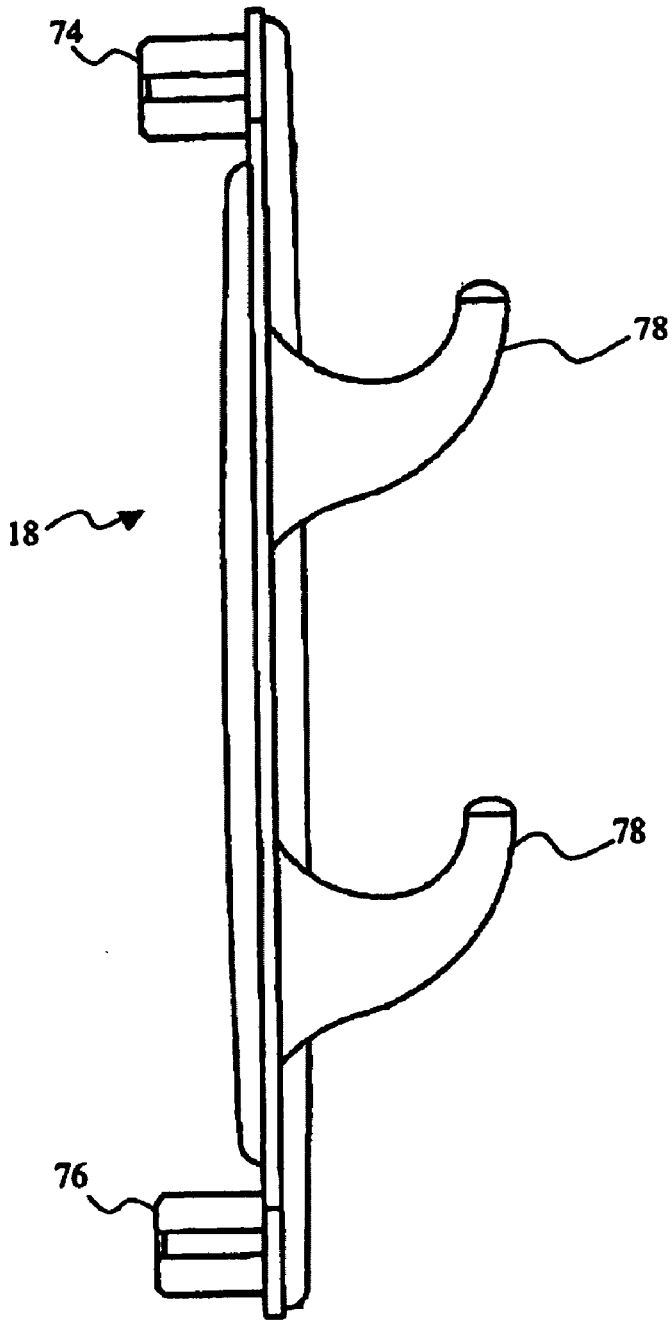
FIG. 4 is a side elevation of a brace for use in connection with the shoe rack of FIG. 1.

The rack 10 may include a set of braces 18 to aid in coupling together modules 12*a–c*, as shown in FIG. 1. Each brace 18 is adapted to extend generally vertically between the distal ends of the support arms 38 of adjacent modules 12*a–c*. Details of the brace 18 are depicted in FIG. 4. Each brace 18 may include a generally cylindrical upper brace connector 74, and is adapted to be received in an outer rung receptacle 42 of a support arm 38, such as a bottom-most support arm of module. The brace 18 may include a generally cylindrical lower brace connector 76 and is similarly adapted to couple to an outer receptacle 42 of a support arm 38, such as a top-most support arm. Each of the brace connectors 74, 76 may be shaped to be received in a corresponding receptacle 42 by an interference fit. The brace 18 may also include at least one hook 78 adapted to receive miscellaneous items such as clothing and accessories. Each brace 18 may be considered as a strut 50 which extends between adjacent modules to provide vertical support between adjacent modules 12*a–c*.

Figure 5:
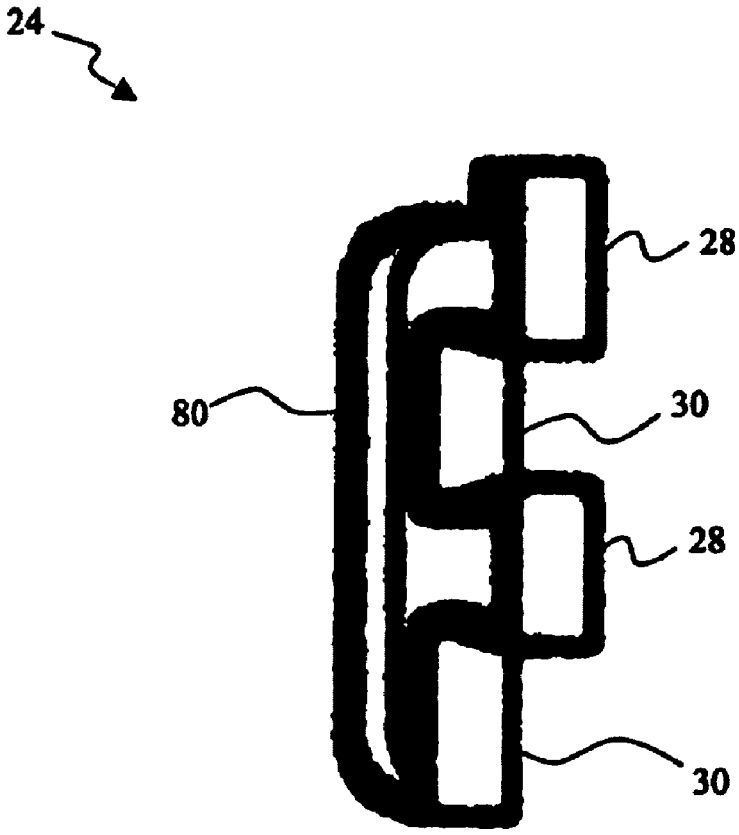
FIG. 5 is a perspective view of a cover for use in connection with the shoe rack of FIG. 1.

The rack 10 may include a pair of covers 24 which can be attached to the lower connector portions 16 of the bottom-most module, such as module 12*c* in FIG. 1. Details of a cover 24 are shown in FIG. 5. The cover 24 may include teeth 28 and recesses 30 which are adapted to mate with corresponding recesses 28 and teeth 30 respectively of the lower connector portion 16. The cover 24 may include a rear bumper surface 80 that is shaped to provide a smooth surface for contacting the door or other vertical support surface when the rack 10 is installed, thereby providing additional stability and preventing damage to the door and/or lower connecting portions 16.

Referring again to FIG. 1 in combination with FIGS. 2 and 3, the shoe rack 10 may be further assembled by coupling together modules 12*a*, 12*b*, and 12*c*. Module 12*a* can be coupled to module 12*b* by coupling the lower connector portions 16 of module 12*a* to the upper connector portions 14 of module 12*b* such that the teeth 28 and recesses 30 of the lower connector portion 14 interfit with the corresponding recesses 30 and teeth 28 respectively of the upper connector portion 16 of module 12*b*. A pair of braces 18 may be installed vertically between the bottom-most outer rung receptacles 42 of module 12*a*, and the uppermost outer rung receptacles 42 of module 12*b*. Module 12*c* can be attached to module 12*b* in a likewise manner. Of course, if desired, additional modules can be added.

A pair of hangers 20 may be attached to an upper connector portion 14 of module 12*a* by positioning the apertures 66 of each hanger over the connector teeth 28 of the upper connector portions 14. The hanger retainer 22 can then be coupled to the upper connector portion 14, captively retaining the hanger lower portion 58 between the retainer 22 and the upper connector portion 14. Once all of the modules 12*a–c* have been installed, a cover 24 may be coupled to each of the lower connecting portions 16 of the bottom-most module, such as module 12*c*.

As can be seen from the figures and description herein, the shoe rack 10 may be modular in nature. The modular nature of the shoe rack 10 enables a user to initially install a single rack module, such as module 12*a*, then add one or more modules such as 12*b*, 12*c* to increase shoe storage capacity when desired. Each additional module may be attached to the bottom of the prior module. The structural integrity of the rack 10 can be maintained by the rigid structure of the modules 12*a–c* as well as the connector portions 14, 16 and braces 18, which serve to provide vertical support for modules 12*b* and 12*c*.

In use, the assembled rack 10 can be attached to a door or other vertical support surface by placing the hangers 20 over the upper horizontal edge of the door, or by utilizing the mounting holes 70, or by some other means. The frames 26 of the rack 10 may rest generally against vertical surface of the door to provide stability and a large surface area of contact. Furthermore, the rear surfaces 34 of each frame 26 may lie against the door to provide generally continuous areas of contact between the rack 10 and the door. Shoes may be placed on the rack 10 by placing the heel of each shoe against an outer rung 48, then directing the toes of the shoes downward to the adjacent inner rung 46. The shoes may also be oriented such that the heels are placed against the inner rung 24 with the toes resting on the outer rung 48. The mounted shoes will be prevented from sliding off laterally by the stability of the rigid rack 10, aided by the lateral restraints provided by the frames 26 and the struts 50. The inner rungs 46, outer rungs 48 and/or spacer portion 60 may be dimensioned and configured such that shoes stored on the rack 10 can be spaced away from the supporting door, thereby preventing scuffing of the door and of the shoes.

While this invention has been shown and described with respect to a detailed embodiment thereof, it will be understood by those skilled in the art that various changes in form and detail thereof may be made without departing from the scope of the claims of the invention.

What is claimed is:

1. A shoe rack comprising:

a first shoe rack module including:

at least one frame structure;

a hanger coupled to said frame structure, said hanger being shaped to couple said shoe rack to a generally vertically-oriented support surface such that said frame structure is located generally adjacent to said support surface;

wherein the frame structure includes a plurality of support arms shaped to extend generally away from said support surface when said frame structure is located generally adjacent to said support surface;

a plurality of generally horizontally-oriented, vertically spaced inner rungs coupled to said frame structure;

a plurality of generally horizontally-oriented, vertically spaced outer rungs coupled to said frame structure; and a plurality of generally vertically-oriented struts, each strut extending between adjacent ones of said outer rungs or adjacent ones of said support arms to provide vertical support to said outer rungs and said support arms, wherein at least one of said inner rungs, or at least one of said outer rungs or at least one of said struts is removably coupled to the associated component;

a second shoe rack module coupled to said first shoe rack module, said second shoe rack module including:

at least one frame structure including a plurality of support arms shaped to extend generally away from said support surface when said frame structure of said second shoe rack is located generally adjacent to said support surface;

a plurality of generally horizontally-oriented, vertically spaced inner rungs coupled to said frame structure of said second shoe rack module;

a plurality of generally horizontally-oriented, vertically spaced outer rungs coupled to said frame structure of said second shoe rack module; and a plurality of generally vertically-oriented struts, each strut extending between adjacent ones of said outer rungs or adjacent ones of said support arms of said second shoe rack module to provide vertical support to said outer rungs and said support arms of said second shoe rack module; and a generally vertically-oriented strut brace extending between one of said outer rungs or a distal end of one of said support arms of said first shoe rack module and one of said outer rungs or a distal end of one of said support arms of said second shoe rack module to provide outer vertical support to said first shoe rack module.

2. The shoe rack of claim 1 wherein each inner rung extends between adjacent ones of said support arms and each outer rung extends between adjacent ones of said support arms.

3. The shoe rack of claim 1 wherein the inner rungs, outer rungs, struts, support arms, and at least part of said frame structure of each shoe rack module form a plurality of generally closed, vertically stacked box-like structures.

4. The shoe rack of claim 3 wherein each box-like structure includes inner rungs, outer rungs, struts, support arms, and at least part of said frame structure of each shoe rack module forming front, rear, left and right sides, each of said sides being generally planar and generally perpendicular to each other.

5. The shoe rack of claim 1 wherein the frame structure of each shoe rack module includes a pair of frames, said frames being generally parallel and spaced apart from each other, each frame including a generally longitudinally-extending base portion and at least two spaced support arms extending generally perpendicular to and generally away from the associated base portion.

6. The shoe rack of claim 5 wherein each inner and outer rung of each shoe rack module extends generally perpendicular to the associated base portion and to the support arms of both frames, and wherein each strut of each shoe rack module extends generally parallel to the base and generally perpendicular to the support arms of both frames of the associated shoe rack module.

7. The shoe rack of claim 1 wherein each strut is integrally formed with an associated support arm.

8. The shoe rack of claim 1 wherein each strut is removably coupled to the associated adjacent ones of said outer rungs or adjacent ones of said support arms.

9. The shoe rack of claim 8 wherein said frame structure of each shoe rack module further includes a plurality of strut receptacles which receive said struts therein in an interference fit.

10. The shoe rack of claim 1 wherein each outer rung is removably coupled to the associated frame structure.

11. The shoe rack of claim 1 wherein each frame structure includes a plurality of outer rung receptacles which receive said associated outer rungs therein in an interference fit.

12. The shoe rack of claim 1 wherein each inner rung is removably coupled to the associated frame structure.

13. The shoe rack of claim 1 wherein each frame structure further includes a plurality of inner rung receptacles which receive the associated inner rungs therein in an interference fit.

14. The shoe rack of claim 1 wherein each support arm is integral with the associated frame structure.

15. The shoe rack of claim 1 wherein each frame structure further includes an upper connector portion and a lower connector portion such that at least one additional frame structure can be coupled to each frame structure via said upper and lower connector portions in a modular manner.

16. The shoe rack of claim 15 wherein each upper connector portion and each lower connector portion further includes a plurality of teeth.

17. The shoe rack of claim 16 further comprising a cover adapted to couple to one of said lower connector portions and provide a smooth outer appearance to said one of said lower connector portions.

18. The shoe rack of claim 1 wherein said hanger is removably coupled to said frame structure of said first shoe rack module.

19. The shoe rack of claim 1 wherein said hanger further includes a generally inverted "U" shaped receiving portion adapted to fit over an upper edge of said support surface.

20. The shoe rack of claim 19 wherein said hanger includes a plurality of perforations to facilitate removal of said receiving portion and a plurality of openings to receive fasteners therethrough to couple said hanger to said support surface.

21. The shoe rack of claim 1 wherein each outer rung is generally horizontally aligned with an associated inner rung.

22. The shoe rack of claim 1 wherein said at least one of said inner rungs, said at least one of said outer rungs or said at least one of said struts that is removably coupled is removably coupled by an interference fit.

23. The shoe rack of claim 1 wherein at least one of said inner rungs, and at least one of said outer rungs, and at least one of said struts is removably coupled to the associated component.

24. The shoe rack of claim 1 wherein each strut is rigid.

25. The shoe rack of claim 1 wherein both of said frame structures are rigid.

26. The shoe rack of claim 1 wherein said strut brace is removably coupled to said first and second shoe rack modules.

27. The shoe rack of claim 1 further comprising another generally vertically-oriented strut brace extending between one of said outer rungs or a distal end of one of said support arms of said first shoe rack module and one of said outer rungs or a distal end of one of said support arms of said second shoe rack module to provide outer vertical support to said first shoe rack module, wherein said strut brace and said another strut brace are located on opposite sides of said first shoe rack module.

28. The shoe rack of claim 1 wherein each arm has a base end located generally adjacent to said support surface and said distal end of each arm is located generally opposite said base end, and wherein said strut base is located generally adjacent to said distal end of one of said arms.

29. A shoe rack comprising:

a first shoe rack module including:

at least one frame structure including a base portion and a plurality of supports extending generally away from said base portion, said frame structure including a plurality of inner rung coupling portions and a plurality of outer rung coupling portions;

a hanger coupled or adapted to be coupled to said frame structure, said hanger being shaped to couple said shoe rack to a generally vertically-oriented support surface;

a plurality of inner rungs adapted to couple to said inner rung coupling portions of said frame structure such that the inner rungs extend generally perpendicular to said frame structure, said inner rungs being adapted to couple to said inner rung coupling portions such that said inner rungs are generally aligned in a first plane;

a plurality of outer rungs adapted to couple to said outer rung coupling portions of said frame structure such that the outer rungs extend generally perpendicular to said frame structure and generally parallel to said plurality of inner rungs, said outer rungs being adapted to couple to said outer rung coupling portions such that said outer rungs are generally aligned in a second plane that is generally parallel to and spaced apart from said first plane; and a plurality of rigid struts adapted to extend between adjacent ones of said support arms or said outer rungs to provide support to said outer rungs and said support arms;

a second shoe rack module configured to be coupled to said first shoe rack module, said second shoe rack module including:

at least one frame structure including a base portion and a plurality of supports extending generally away from said base portion, said frame structure of said second shoe rack module including a plurality of inner rung coupling portions and a plurality of outer rung coupling portions;

a plurality of inner rungs adapted to couple to said inner rung coupling portions of said frame structure of said second shoe rack module such that the inner rungs of said second shoe rack module extend generally perpendicular to said frame structure of said second shoe rack module, said inner rungs being adapted to couple to said inner rung coupling portions of said second shoe rack module such that said inner rungs are generally aligned in a first plane;

a plurality of outer rungs adapted to couple to said outer rung coupling portions of said frame structure of said second shoe rack module such that the outer rungs of said second shoe rack module extend generally perpendicular to said frame structure of said second shoe rack module and generally parallel to said plurality of inner rungs of said second shoe rack module, said outer rungs being adapted to couple to said outer rung coupling portions of said second shoe rack module such that said outer rungs are generally aligned in a second plane that is generally parallel to and spaced apart from said first plane; and a plurality of rigid struts adapted to extend between adjacent ones of said support arms or said outer rungs of said second shoe rack module to provide support to said outer rungs and said support arms of said second shoe rack module; and a generally vertically-oriented strut brace configured to extend between one of said outer rungs or a distal end of one of said support arms of said first shoe rack module and one of said outer rungs or a distal end of one of said support arms of said second shoe rack module to provide outer vertical support to said first shoe rack module.

30. The shoe rack of claim 29 wherein each inner rung is adapted to extend between adjacent ones of said support arms and each outer rung is adapted to extend between adjacent ones of said support arms.

31. The shoe rack of claim 29 wherein the inner rungs, outer rungs, struts, support arms, and at least part of said frame structure of said first and second shoe rack modules are adapted to form a plurality of generally closed, rigid vertically stacked box-like structures when assembled.

32. The shoe rack of claim 29 wherein the frame structure of said first and second shoe rack modules each includes a pair of frames, said frames being adapted to be generally parallel and spaced apart from each other.

33. The shoe rack of claim 29 wherein said hanger includes a generally inverted "U" shaped receiving portion adapted to fit over an upper edge of said support surface.

34. The shoe rack of claim 29 wherein each outer rung is adapted to be generally aligned with an associated inner rung.

35. The shoe rack of claim 29 wherein at least one of said inner rungs, or at least one of said outer rungs is adapted to be removably coupled to the associated component.

36. The shoe rack of claim 29 wherein both of said frame structures are rigid.

37. The shoe rack of claim 29 wherein said strut brace is configured to be removably coupled to said first and second shoe rack modules.

38. The shoe rack of claim 29 further comprising another generally vertically-oriented strut brace configured to extend between one of said outer rungs or a distal end of one of said support arms of said first shoe rack module and one of said outer rungs or a distal end of one of said support arms of said second shoe rack module to provide outer vertical support to said first shoe rack module.

39. The shoe rack of claim 29 wherein each arm has a base end located generally adjacent to said support surface and said distal end is located generally opposite said base end, and wherein said strut base is configured to be located generally adjacent to said distal end of one of said arms.

40. A method for assembling a shoe rack, comprising the steps of:

obtaining a first modular frame structure having a hanger coupled thereto, said hanger being shaped to couple said shoe rack to a generally vertically-oriented support surface such that said first frame structure is located generally adjacent to said support surface, and wherein the first frame structure includes a plurality of support arms extending generally away from said support surface when said first frame structure is located generally adjacent to said support surface, and wherein the support arms include a plurality of struts extending generally perpendicularly between adjacent ones of said support arms to provide vertical support to said outer rungs and said support arms;

releasably coupling a plurality of generally horizontally-oriented, vertically spaced inner rungs to said first frame structure;

releasably coupling a plurality of generally horizontally-oriented, vertically spaced outer rungs to said first frame structure;

providing a second modular frame structure configured to store shoes therein or thereon; and coupling said second modular frame structure to a bottom edge of said first modular frame structure with a strut brace such that said strut brace provides outer vertical support to a distal end of one of said support arms or one of said outer rungs of said first modular frame structure.

41. The method of claim 40 further comprising the step of coupling said shoe rack to said vertical support surface.

42. The method of claim 41 further comprising the step of locating shoes on said shoe rack such that said shoes rest on and are supported by selected ones of said inner and outer rungs.

43. The method of claim 40 wherein each strut is rigid.

44. The method of claim 40 wherein each strut is positioned such that each strut is positioned between adjacent ones of said support arms before either of said coupling steps.

45. The method of claim 40 wherein each strut is positioned such that each strut is positioned between adjacent ones of said support arms after either of said coupling steps.

46. The method of claim 40 wherein said coupling step includes removably coupling said strut brace said first and second shoe rack modules.

47. A method for storing shoes, comprising the steps of: providing a shoe rack, wherein the shoe rack includes:

a first shoe rack module including:

at least one frame structure, a hanger coupled to said frame structure, said hanger being shaped to couple said shoe rack to a generally vertically-oriented support surface such that said frame structure is located generally adjacent to said support surface, wherein the frame structure includes a plurality of support arms shaped to extend generally away from said support surface when said frame structure is located generally adjacent to said support surface, a plurality of generally horizontally-oriented, vertically spaced inner rungs coupled to said frame structure, a plurality of generally horizontally-oriented, vertically spaced outer rungs coupled to said frame structure, and a plurality of generally vertically-oriented struts, each strut extending between adjacent ones of said outer rungs or adjacent ones of said support arms to provide vertical support to said outer rungs and said support arms, wherein at least one of said inner rungs, or at least one of said outer rungs or at least one of said struts is removably coupled to the associated component;

a second shoe rack module coupled to said first shoe rack module, said second shoe rack module being configured to store shoes thereon or therein, said second shoe rack module having a distal end configured to be located away from said support surface when said second shore rack module is located adjacent to said support surface; and a generally vertically-oriented strut brace extending between one of said outer rungs or a distal end of one of said support arms of said first shoe rack module and said distal end of said of said second shoe rack module to provide outer vertical support to said first shoe rack module;

coupling the shoe rack to a generally vertically oriented support surface; and placing a pair of shoes onto the inner and outer rungs such that the shoes rest on the inner and outer rungs.

48. The method of claim 47 wherein said at least one of said inner rungs, said at least one of said outer rungs or said at least one of said struts that is removably coupled is removably coupled by an interference fit.

49. The method of claim 47 wherein each strut is rigid.

50. A shoe rack comprising:

a first shoe rack module comprising:

a frame structure;

a hanger coupled to said frame structure, said hanger being shaped to couple said shoe rack to a generally vertically-oriented support surface such that said frame structure is located generally adjacent to said support surface;

wherein the frame structure includes a plurality of support arms extending generally away from said support surface;

a plurality of generally horizontally-oriented, vertically spaced inner rungs coupled to said frame structure;

a plurality of generally horizontally-oriented, vertically spaced outer rungs extending between adjacent ones of said support arms, wherein each outer rung is generally horizontally aligned with an associated inner rung; and a plurality of generally vertically-extending rigid connectors, each connector extending between adjacent ones of said outer rungs, adjacent ones of said inner rungs, or adjacent ones of said support arms to provide vertical support to said inner rungs, outer rungs, or support arms;

a second shoe rack module coupled to said first shoe rack module, said second shoe rack module being configured to store shoes thereon or therein, said second shoe rack module having a distal end configured to be located away from said support surface when said second shoe rack module is located adjacent to said support surface; and a generally vertically-oriented strut brace extending between one of said outer rungs or a distal end of one of said support arms of said first shoe rack module and said distal end of said second shoe rack module to provide outer vertical support to said first shoe rack module.

51. The shoe rack of claim 50 wherein at least one of said inner rungs, or at least one of said outer rungs or at least one of said connectors is removably coupled to the associated component.

52. The shoe rack of claim 50 further comprising another generally vertically-oriented strut brace extending between one of said outer rungs or a distal end of one of said support arms of said first shoe rack module and said distal end of said second shoe rack module to provide outer vertical support to said first shoe rack module, wherein said strut brace and said another strut brace are located on opposite sides of said first shoe rack module.

53. The shoe rack of claim 50 wherein each arm has a base end located generally adjacent to said support surface and said distal end of each arm is located generally opposite said base end, and wherein said strut base is located generally adjacent to said distal end of one of said arms.

54. The shoe rack of claim 50 wherein said second shoe rack module includes:

a frame structure configured to be located generally adjacent to said support surface, wherein the frame structure of said second shoe rack module includes a plurality of support arms extending generally away from said support surface;

a plurality of generally horizontally-oriented, vertically spaced inner rungs coupled to said frame structure of said second shoe rack module;

a plurality of generally horizontally-oriented, vertically spaced outer rungs extending between adjacent ones of said support arms of said frame structure of said second shoe rack module, wherein each outer rung is generally horizontally aligned with an associated inner rung; and a plurality of generally vertically-extending rigid connectors, each connector extending between adjacent ones of said outer rungs, adjacent ones of said inner rungs, or adjacent ones of said support arms of said second shoe rack module to provide vertical support to said inner rungs, outer rungs, or support arms of said second shoe rack module.

55. A shoe rack comprising:

a first shoe rack module including:

a pair of frames, said frames being generally parallel and spaced apart from each other, each frame including a generally longitudinally-extending base and at least two spaced support arms extending generally perpendicular to and generally away from said base;

a pair of spaced, generally parallel inner rungs extending generally perpendicular to and between said frames;

a pair of spaced, generally parallel outer rungs extending generally perpendicular to and between said frames;

a pair of spaced, generally parallel struts, each strut extending generally parallel to and between portions of an associated frame; and wherein said frames, inner rungs, outer rungs and struts form a generally closed box-like shape and wherein at least one of said inner rungs, or at least one of said outer rungs or at least one of said struts is removably coupled to the associated component;

a second shoe rack module coupled to said first shoe rack module;

a generally vertically-oriented strut brace extending between one of said outer rungs or a distal end of one of said support arms of said first shoe rack module and one of said outer rungs or a distal end of one of said support arms of said second shoe rack module to provide outer vertical support to an upper one of said first or second shoe rack modules; and a hanger coupled to at an upper one of said shoe rack modules, said hanger being shaped to couple said shoe rack to a generally vertically-oriented support surface.

56. The shoe rack of claim 55 wherein said at least one of said inner rungs, said at least one of said outer rungs or said at least one of said struts that is removably coupled is removably coupled by an interference fit.

57. The shoe rack of claim 55 wherein each strut is rigid.

58. The shoe rack of claim 55 wherein said generally closed box-like shape is generally rigid in all directions thereof.

59. The shoe rack of claim 50 wherein said strut brace is removably coupled to said first and second shoe rack modules.

* * * * *

UNITED STATES PATENT AND TRADEMARK OFFICE

CERTIFICATE OF CORRECTION

PATENT NO. : 7,097,048 B2
APPLICATION NO. : 10/613662
DATED : August 29, 2006
INVENTOR(S) : Peter D. Rimback et al.

It is certified that error appears in the above-identified patent and that said Letters Patent is hereby corrected as shown below:

Title page should be deleted and substitute therefor the attached title page.

Drawings
In Fig. 1, change “12” to --12a --.

Signed and Sealed this

Twenty-seventh Day of February, 2007

JON W. DUDAS
*Director of the United States Patent and Trademark Office*

(12) United States Patent
Rimback et al.

(10) Patent No.: US 7,097,048 B2
(45) Date of Patent: Aug. 29, 2006

(54) SHOE RACK

(75) Inventors: Peter D. Rimback, South Euclid, OH (US); James F. Vidmar, Willoughby, OH (US)

(73) Assignee: HSN Improvements, LLC, St. Petersburg, FL (US)

( * ) Notice: Subject to any disclaimer, the term of this patent is extended or adjusted under 35 U.S.C. 154(b) by 163 days.

(21) Appl. No.: 10/613,662

(22) Filed: Jul. 2, 2003

(65) Prior Publication Data

US 2004/0118791 A1 Jun. 24, 2004

Related U.S. Application Data

(60) Provisional application No. 60/393,461, filed on Jul. 2, 2002.

(51) Int. Cl.
*A47F 7/08* (2006.01)

(52) U.S. Cl. ..... 211/34

(58) Field of Classification Search ..... 211/34, 211/35, 113, 118, 119.004, 36, 119.003
See application file for complete search history.

(56) References Cited

U.S. PATENT DOCUMENTS

| | | | | | |
|---|---|---|---|---|---|
| 1,769,344 | A | * | 7/1930 | Hoffmire | 211/34 |
| D121,112 | S | * | 6/1940 | Deja | D6/317 |
| 2,299,021 | A | * | 10/1942 | Hoffman | 211/34 |
| 2,620,929 | A | | 12/1952 | Sportsman | 211/42 |
| 3,792,804 | A | | 2/1974 | Ponzo | 223/85 |
| D287,550 | S | * | 1/1987 | Tocci | D6/320 |
| D377,728 | S | * | 2/1997 | Klein et al. | D6/570 |
| 5,617,959 | A | * | 4/1997 | Klein et al. | 211/37 |
| D381,225 | S | * | 7/1997 | Malik | D6/513 |
| D382,434 | S | | 8/1997 | Klein et al. | D6/570 |
| D385,481 | S | | 10/1997 | Klein et al. | D8/373 |
| 5,690,239 | A | * | 11/1997 | Ballard | 211/189 |
| 5,695,073 | A | | 12/1997 | Klein et al. | 211/35 |
| 5,855,279 | A | | 1/1999 | Klein et al. | 211/35 |
| 6,464,086 | B1 | * | 10/2002 | Klein et al. | 211/35 |
| D481,560 | S | * | 11/2003 | Vidmar et al. | D6/491 |
| 6,786,337 | B1 | * | 9/2004 | Klein et al. | 211/34 |
| 2003/0085188 | A1 | * | 5/2003 | Klein et al. | 211/118 |
| 2004/0245192 | A1 | * | 12/2004 | Hu | 211/34 |

* cited by examiner

*Primary Examiner*—Sarah Purol
(74) *Attorney, Agent, or Firm*—Kenyon & Kenyon LLP

(57) ABSTRACT

A shoe rack including at least one frame structure and a hanger coupled to the frame structure, the hanger being shaped to couple the shoe rack to a generally vertically-oriented support surface such that the frame structure is located generally adjacent to the support surface. The frame structure includes a plurality of support arms shaped to extend generally away from the support surface when the frame structure is located generally adjacent to the support surface. The rack includes a plurality of generally horizontally-oriented, vertically spaced inner rungs coupled to the frame structure and a plurality of generally horizontally-oriented, vertically spaced outer rungs coupled to the frame structure. The rack further includes a plurality of generally vertically-oriented struts, each strut extending between adjacent ones of the outer rungs or adjacent ones of the support arms to provide vertical support to the outer rungs and the support arms.

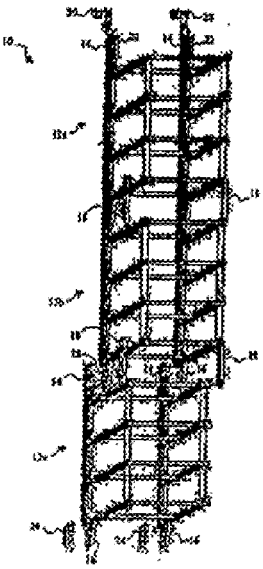

59 Claims, 5 Drawing Sheets